US006464748B2

(12) United States Patent
Perez et al.

(10) Patent No.: US 6,464,748 B2
(45) Date of Patent: Oct. 15, 2002

(54) TOOL FOR COLDFORMING OPERATIONS

(75) Inventors: Francisco Fernandez Perez, El Masnou (ES); Emmanuel Pauty, Echirolles (FR)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/962,589

(22) Filed: Sep. 26, 2001

(65) Prior Publication Data

US 2002/0059849 A1 May 23, 2002

(30) Foreign Application Priority Data

Sep. 27, 2000 (SE) ..... 0003469

(51) Int. Cl.[7] ..... C22C 29/08
(52) U.S. Cl. ..... 75/240
(58) Field of Search ..... 75/240

(56) References Cited

U.S. PATENT DOCUMENTS 4,753,678 A * 6/1988 Maruyama et al. ..... 75/238
4,820,482 A * 4/1989 Fischer et al. ..... 419/15
5,334,561 A * 8/1994 Matsui et al. ..... 501/87
5,403,652 A * 4/1995 Drougge ..... 428/216
5,948,523 A 9/1999 Carpenter et al.
6,086,650 A * 7/2000 Carpenter ..... 75/240
6,241,799 B1 * 6/2001 Galli ..... 75/236

OTHER PUBLICATIONS

Patent Abstracts of Japan, Abstract of JP 10298698 A, Nov. 10, 1998.
Patent Abstract of Japan, Abstract of JP 04210447, Jul. 31, 1992.

* cited by examiner

*Primary Examiner*—Ngoclan Mai
(74) *Attorney, Agent, or Firm*—Burns, Doane, Swecker & Mathis, L.L.P.

(57) ABSTRACT

The present invention relates to cemented carbide tools for coldforming and drawing operations. The cemented carbide comprises WC with an average grain of <1 μm and 0.5–4 weight-% binder phase consisting of Co and Ni, <0.5 wt-% Mo, and <1 wt-% grain growth inhibitors V and/or Cr. The weight ratio Co:(Co+Ni) is 0.25–0.75 and the structure contains 1–5 vol-% of finely distributed eta phase with a size <5 μm.

10 Claims, 2 Drawing Sheets

TOOL FOR COLDFORMING OPERATIONS

FIELD OF THE INVENTION

The present invention relates to a tool for coldforming and drawing operations.

DESCRIPTION OF THE RELATED ART

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

Cemented carbide products are used in tools for different coldforming or drawing operations of materials like; steels, copper alloys, composite materials, etc. Examples of such tools are wire drawing dies, which consist of a cemented carbide nib shrink fit into a metallic holder. Such tools should have a hard and wear resistant body which also should have the following additional properties:

good thermal conductivity low coefficient of friction (i.e. it may be self-lubricating or assist lubrication with a coolant)

good corrosion resistance resistance to micro cracking and high hardness.

When using cemented carbides in tools for the drawing of e.g., steel or other metallic alloys, chemical reactions might occur between the binder metal of the cemented carbide and the metallic alloy. In order to minimize the effects of chemical wear of the binder phase and to improve the wear resistance, a cobalt (binder) content of about 3% and a WC grain size <1 μm is used in hard metals for such applications. Often a low carbon content close to eta phase formation is chosen. In order to maintain the fine grain size, grain growth inhibitors are used such as VC, $Cr_3C_2$, etc.

U.S. Pat. No. 5,948,523 discloses coldforming tool with an improved hard wearing surface zone. This has been achieved by a post-sintering heat treatment in a boron nitride containing environment of a hard metal of a suitable composition. The effect is most pronounced when the heat treatment is made of a hard metal which has previously been sintered to achieve a high carbon content through a suitable choice of chemical composition and processing conditions.

SUMMARY OF THE INVENTION

It is an object of the present invention to provide a tool for coldforming and drawing operations with a further improved combination of high wear resistance, thermal conductivity, corrosion resistance keeping a good toughness.

BRIEF DESCRIPTION OF THE DRAWING FIGURES

DETAILED DESCRIPTION OF THE INVENTION

While the present invention has been described by reference to the above-mentioned embodiments, certain modifications and variations will be evident to those of ordinary skill in the art. Therefore, the present invention is to be limited only by the scope and spirit of the appended claims.

It has now surprisingly been found that a tool for coldforming and drawing operations with a better performance than prior art tools can be obtained if the tool is made of a cemented carbide comprising WC with an average grain of <1 μm, preferably <0.7 μm, and 0.5–4 weight-% binder phase consisting of Co and Ni, <0.5 wt-% Mo, <1 wt-% grain growth inhibitors V and/or Cr. The weight ratio Co:(Co+Ni) shall be 0.25–0.75, preferably 0.4–0.6. The structure contains 1–5 vol-% of finely distributed eta-phase with a size <5 μm.

One preferred embodiment contains 2.5–3.5 wt-% binder phase and 0.15–0.25 wt-% Mo and <0.7 wt-% grain growth inhibitors.

Another preferred embodiment contains 1.4–1.7 wt-% binder phase and 0.05–0.15 wt-% Mo and <0.4 wt-% grain growth inhibitors.

The cemented carbide is made by conventional powder metallurgical techniques such as milling, pressing and sintering. The carbon content is adjusted by adding W-powder to obtain the desired amount of eta-phase.

The invention also relates to the use of the cemented carbide according to the invention for coldforming operations such as drawing and canning.

Example 1

Figure 1:
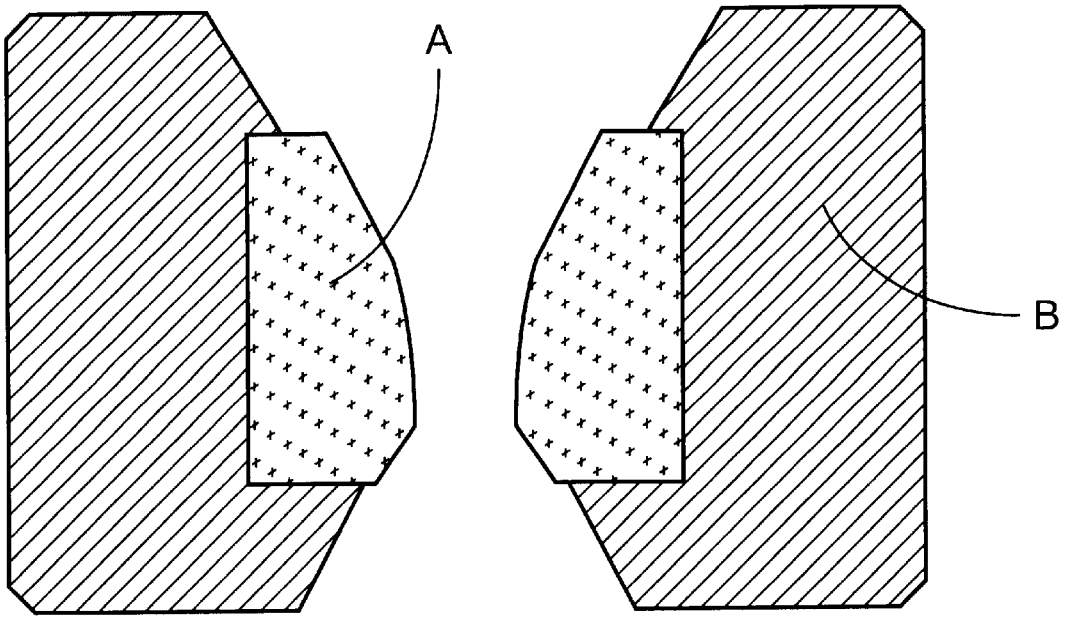
FIG. 1 shows a drawing die in which A=cemented carbide nib and B=steel casing.

Steel wire-drawing dies with inner diameters between 0.2 and 1.3 μm and external diameter between 6 and 11.5 μm according to FIG. 1 were manufactured according to the following:

A. WC-3% Co, submicron grain size, VC as grain growth inhibitor, prior art.

Figure 2:
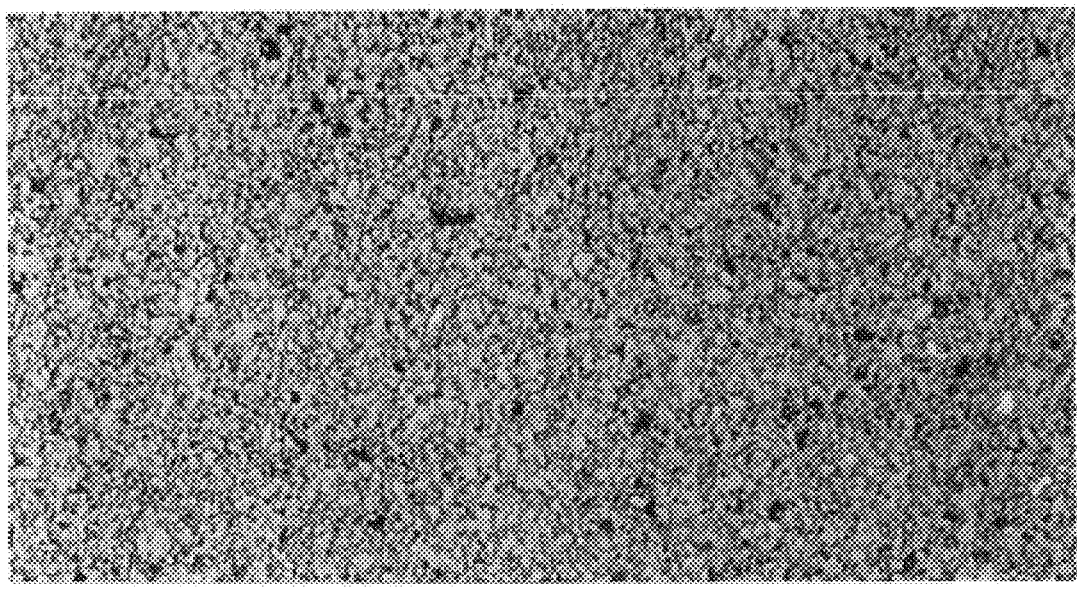
FIG. 2 shows in ×1500 magnification the microstructure of a cemented carbide according to the present invention etched in Murakami. The fine distributed black phase is eta-phase.

B. WC-1.5 wt-% Co+1.5 wt-% Ni, 0.2 wt-% Mo, 0.5 wt-% $Cr_3C_2$ 0.1 wt-% VC, 0.4 wt-% W with average WC grain size 0.6 μm, see FIG. 2.

C. WC-0.75 wt-% Co+0.75 wt-% Ni, 0.1 wt-% Mo, 0.25 wt-% $Cr_3C_2$ 0.05 wt-% VC, 0.4 wt-% W with average WC grain size 0.6 μm.

The tools were tested in the wire drawing of brass coated steel wires with high tensile stresses for tire applications with the following results. Performance factor relates to the quantity of product (wire) as length of mass drawn through the different nibs relative to the prior art nib, A. Table 1 summarizes the results.

TABLE 1

| Sample | Performance Factor |
|---|---|
| A. prior art | 1 |
| B. invention | 3 |
| C. invention | 2.5 |

Example 2

Example 1 was repeated with dies corresponding to A and B under the following conditions.

Dies:

External diam. 24×7 mm.

External diam. 7×4 mm.

Incoming diam. 0.235 mm

Internal profile $2\alpha=10°$

Bearing=0.035 mm

Steel of the wire: AISI 1005. Initially has a resistance of 36 kg/mm$^2$ but at this latest step its resistance is around 80 kg/mm$^2$.

Drawing speed: 25 m/s (very high speed, is around 60% higher than the standard one for this type of drawing).

Table 2 summarizes the results.

TABLE 2

| Sample | Wear ($\mu$m/hour) |
|---|---|
| A. prior art | 0.39 $\mu$m/hour |
| B. invention | 0.10 $\mu$m/hour |

Thus, dies according to the invention performed four times better than those according to prior art.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. Cemented carbide comprising WC with an average grain size of <1 $\mu$m and 0.5–4 wt-% binder phase consisting of Co and Ni, <0.5 wt-% Mo, and <1 wt-% grain growth inhibitors V and/or Cr, wherein a weight ratio Co:(Co+Ni) is 0.25–0.75 and a structure contains 1–5 vol-% of finely distributed eta phase with a size <5 $\mu$m.

2. The cemented carbide according to claim 1, wherein the binder phase content is 2.5–3.5 wt-%, 0.15–0.25 wt-% Mo and <0.7 wt-% grain growth inhibitors.

3. The cemented carbide according to claim 1, wherein the binder phase content is 1.4–1.7 wt-%, 0.05–0.15 wt-% Mo and <0.4 wt-% grain growth inhibitors.

4. The cemented carbide according to claim 1, wherein the WC has an average grain size of <0.7 $\mu$m.

5. The cemented carbide according to claim 1, wherein the weight ratio Co:(Co+Ni) is 0.4–0.6.

6. A tool for coldforming and drawing operations comprising WC cemented carbide with an average grain size of <1 $\mu$m and 0.5–4 wt-% binder phase consisting of Co and Ni, <0.5 wt-% Mo, and <1 wt-% grain growth inhibitors V and/or Cr, wherein a weight ratio Co:(Co+Ni) is 0.25–0.75 and a structure contains 1–5 vol-% of finely distributed eta-phase with a size <5 $\mu$m.

7. The tool according to claim 6, wherein the cemented carbide further comprises 2.5–3.5 wt-% binder phase, 0.15–0.25 wt-% Mo and <0.7 wt-% grain growth inhibitors.

8. The tool according to claim 6, wherein the cemented carbide further contains 1.4–1.7 wt-% binder phase, 0.05–0.15 wt-% Mo and <0.4 wt-% grain growth inhibitors.

9. The tool according to claim 6, the WC has an average grain size of <0.7 $\mu$m.

10. The tool according to claim 6, wherein the weight ratio Co:(Co+Ni) is 0.4–0.6.

* * * * *